US008356612B2

(12) United States Patent
Liu

(10) Patent No.: US 8,356,612 B2
(45) Date of Patent: Jan. 22, 2013

(54) STOPPER FOR RUNNER OF UMBRELLA

(76) Inventor: Fu-Tien Liu, Taipei (TW)

( * ) Notice: Subject to any disclaimer, the term of this patent is extended or adjusted under 35 U.S.C. 154(b) by 56 days.

(21) Appl. No.: 12/926,631

(22) Filed: Dec. 1, 2010

(65) Prior Publication Data

US 2011/0155194 A1 Jun. 30, 2011

(30) Foreign Application Priority Data

Dec. 25, 2009 (CN) ..... 2009 2 0262043 U

(51) Int. Cl.
*A45B 25/08* (2006.01)

(52) U.S. Cl. ..... 135/28; 135/39; 135/41; 135/25.4

(58) Field of Classification Search ..... 135/25.1, 135/25.4, 28, 31–32, 37–41
See application file for complete search history.

(56) References Cited

U.S. PATENT DOCUMENTS

| | | | | |
|---|---|---|---|---|
| 1,010,089 | A * | 11/1911 | Szabados | 135/25.4 |
| 1,613,287 | A * | 1/1927 | Moser | 135/25.4 |
| 4,951,695 | A * | 8/1990 | Yang | 135/29 |
| 5,287,869 | A * | 2/1994 | Wu | 135/25.1 |
| 5,515,878 | A * | 5/1996 | Wu | 135/28 |
| 5,588,455 | A * | 12/1996 | Kuo | 135/28 |
| 6,382,222 | B1 * | 5/2002 | Ko | 135/41 |
| 6,941,960 | B2 * | 9/2005 | Huang | 135/41 |
| 7,204,261 | B1 * | 4/2007 | Wu | 135/28 |
| 7,311,110 | B2 * | 12/2007 | Wu | 135/24 |
| 7,806,130 | B2 * | 10/2010 | Gobel | 135/28 |
| 2006/0151020 | A1 * | 7/2006 | Lin et al. | 135/25.1 |
| 2008/0289668 | A1 * | 11/2008 | Liu | 135/20.3 |

FOREIGN PATENT DOCUMENTS

JP 2005058623 A * 3/2005

* cited by examiner

*Primary Examiner* — Winnie Yip

(57) ABSTRACT

An umbrella includes a shaft with a top member connected to a top end thereof and a runner is movably mounted to the shaft. Multiple stretchers are pivotably connected between the top member and the runner. The shaft includes an inner tube and an outer tube in which the inner tube is retractably received. The runner is movably mounted to the outer tube and a stopper extends outward from an outside of the outer tube. The runner is movable over the stopper and supported by the stopper when the umbrella is opened. The shaft does not need to make a slot so as to have better strength and the inner diameter of the runner and the outer diameter of the stopper is matched so that the runner does shake.

5 Claims, 6 Drawing Sheets

STOPPER FOR RUNNER OF UMBRELLA

BACKGROUND OF THE INVENTION (1) Field of the Invention

The present invention relates to an umbrella, and more particularly, to a stopper for supporting the runner when the umbrella is opened.

(2) Description of the Prior Art

A conventional umbrella generally includes a shaft with a runner movably mounted to the shaft and the runner is moved upward along the shaft to stretch the stretchers when opening the umbrella. The shaft has to be made a slot in which a stopper is pivotably engaged and the runner is moved over the stopper when moving and the runner is stopped by the stopper to maintain the opened status of the umbrella. Nevertheless, the slot made in the shaft makes the shaft to be weak especially for those shafts of foldable umbrellas having multiple tubes.

Besides, the inner diameter is small for the tubes and the inner diameter of the runner is large so that the runner shakes during opening the umbrella.

The present invention intends to provide an umbrella that does not need a slot defined through the wall of the shaft to hold the runner so as to improve the shortcomings of the conventional umbrellas.

SUMMARY OF THE INVENTION

The present invention relates to an umbrella which comprises a shaft with a top member connected to a top end thereof and a runner is movably mounted to the shaft. Multiple stretchers are pivotably connected between the top member and the runner. The shaft includes an inner tube and an outer tube in which the inner tube is retractably received. The runner is movably mounted to the outer tube. The outer tube has a stopper extending outward from an outside thereof and the runner is movable over the stopper and supported by the stopper when the umbrella is opened.

The outer diameter of the stopper is slightly smaller than the inner diameter of the runner so that the runner does shake.

The stopper is an annular member fixed on the outer tube.

The stopper is an annular member which is integrally formed with the outer tube.

The stopper is an annular member which is composed of multiple pieces fixed to the outer tube.

The stopper is an annular member which is composed of multiple pieces integrally formed with the outer tube.

The engagement between the stopper and the runner ensures the opened status of the umbrella and the shaft does not need to have any slot so as to keep the shaft to have strong strength.

The outer diameter of the stopper is slightly smaller than the inner diameter of the runner so that when the umbrella is opened, the runner is mounted to the stopper and does shake.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figures 1, 1A:
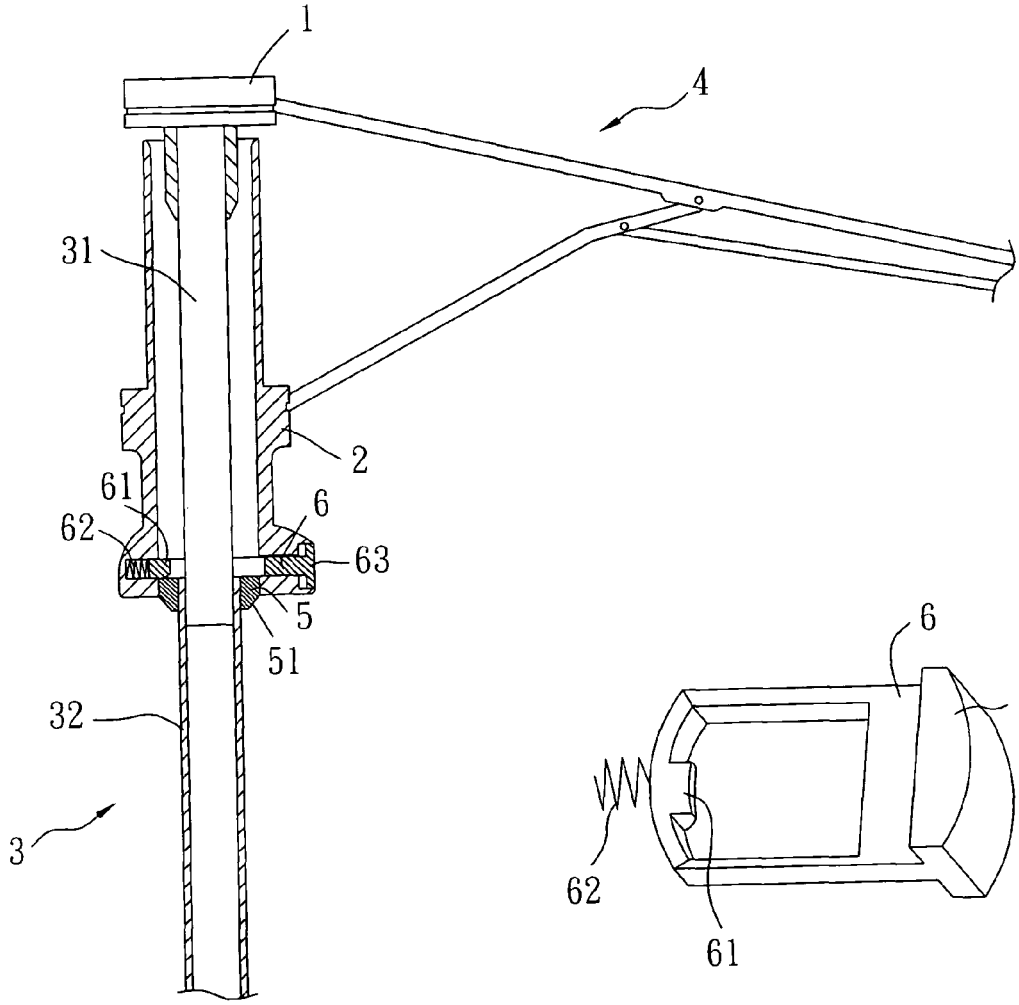
FIG. 1 is a cross sectional view of a part of the umbrella of the present invention.
FIG. 1*a* shows the button of the umbrella of the present invention.

Referring to FIGS. 1 and 1*a*, the umbrella of the present invention comprises a shaft 3 with a top member 1 connected to a top end thereof and a runner 2 is movably mounted to the shaft 3. Multiple stretchers 4 are pivotably connected between the top member 1 and the runner 2. The shaft 3 includes an inner tube 31 and an outer tube 32 in which the inner tube 31 is retractably received. The runner 2 is movably mounted to the outer tube 32. The outer tube 32 has a stopper 5 extending outward from an outside thereof and the runner 2 is movable over the stopper 5 and supported by the stopper 5 when the umbrella is opened. A button 6 is cooperated with the runner 2 to control the umbrella.

The button 6 is connected to the runner 2 and is an enclosed member through which the shaft 31 extends. The button 6 includes a protrusion 61 extending from an inside thereof and a spring 62 is biased between a recess in the runner 2 and the outside of the button 6. A press portion 63 is formed on an outside of the button 6 so that when opening the umbrella, the runner 2 is moved upward and over the stopper 5, the protrusion 61 of the button 6 is moved when the spring 62 is compressed. After the protrusion 61 moves over the stopper 5, the protrusion 61 is rested on the stopper 5 to support the runner 2. When folding the umbrella, the user pushes the press portion 63 so that the protrusion 61 is disengaged from the stopper 5 so that the runner 5 is moved downward to fold the umbrella. The outer diameter of the stopper 5 is slightly smaller than the inner diameter of the runner 2 so that when the umbrella is opened, the runner 2 is mounted to the stopper 5 and does shake. In this embodiment, the stopper 5 has a tapered lower outer periphery 51 so that the protrusion 61 can be guided along the tapered lower outer periphery 51 and moved to the top of the stopper 5.

Figures 2, 2A:
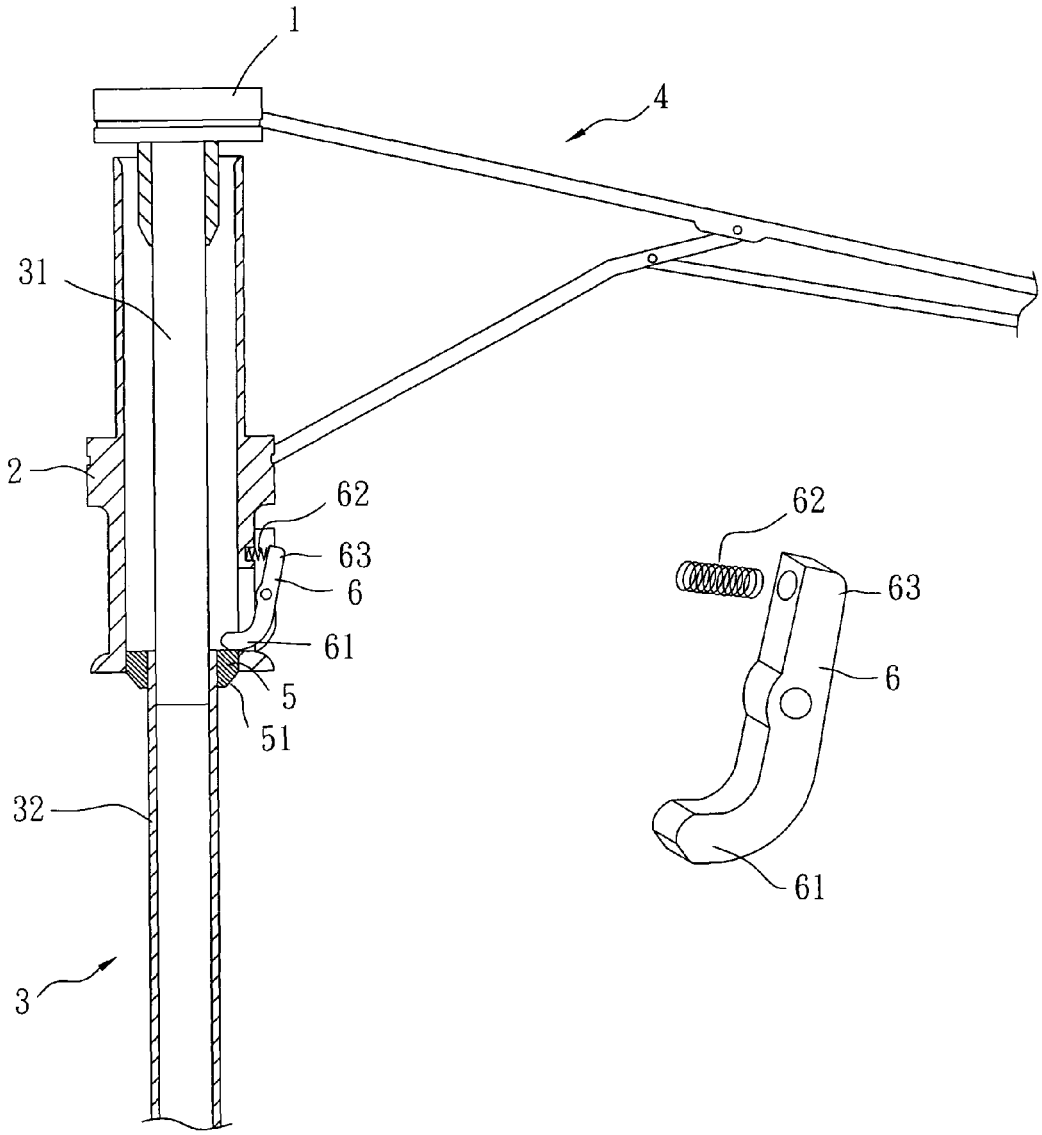
FIG. 2 is a cross sectional view of a part of the second embodiment of the umbrella of the present invention.
FIG. 2*a* shows the button of the umbrella in FIG. 2 of the present invention.

FIGS. 2 and 2*a* show that the button 6 is pivotably connected to the runner 2 and includes a press portion 63 on one end thereof and a spring 62 is connected to the inside of the press portion 63. A protrusion 61 extends from the other end of the button 6 and normally extends toward the shaft 3 because the spring 62 pushes the press portion 63. The protrusion 61 is located on the top of the stopper 5 to support the runner 2 when the umbrella is opened. When folding the umbrella, the press portion 63 is pushed to compress the spring 62 and the protrusion 63 is moved away from the stopper 5 such that the runner 2 is able to be moved over the stopper 5 and fold the umbrella.

Figure 3:
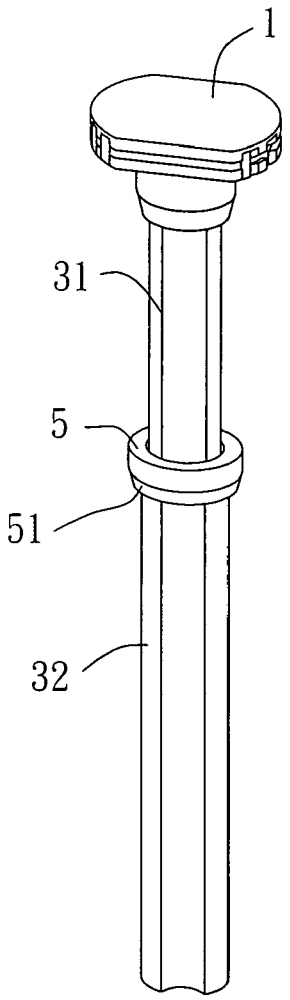
FIG. 3 is a perspective view to show the stopper on the outer tube of the shaft of the umbrella of the present invention.
Figure 4:
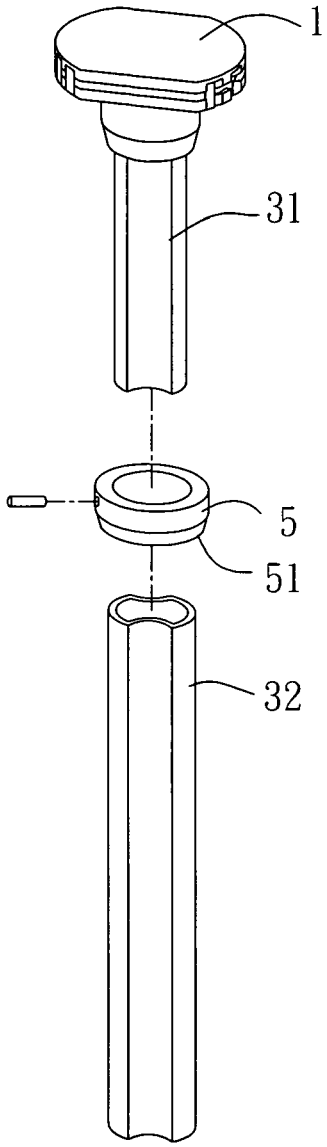
FIG. 4 is an exploded view of the stopper in FIG. 3 of the umbrella of the present invention.

FIGS. 3 and 4 show that the stopper 5 is an annular member and fixed on the outer tube 32 by using a rivet. By the stopper 5, the shaft 3 does not need to be made a slot and maintains the structural strength which ensures that the shaft 3 does not break during operation.

Figure 5:
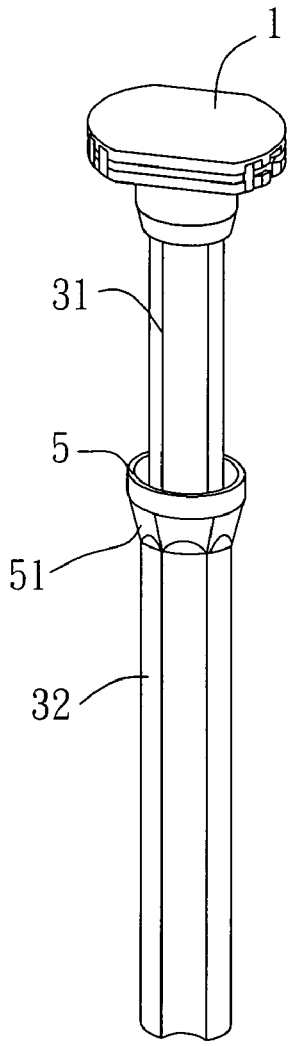
FIG. 5 is a perspective view to show the second embodiment of the stopper on the outer tube of the shaft of the umbrella of the present invention.
Figure 6:
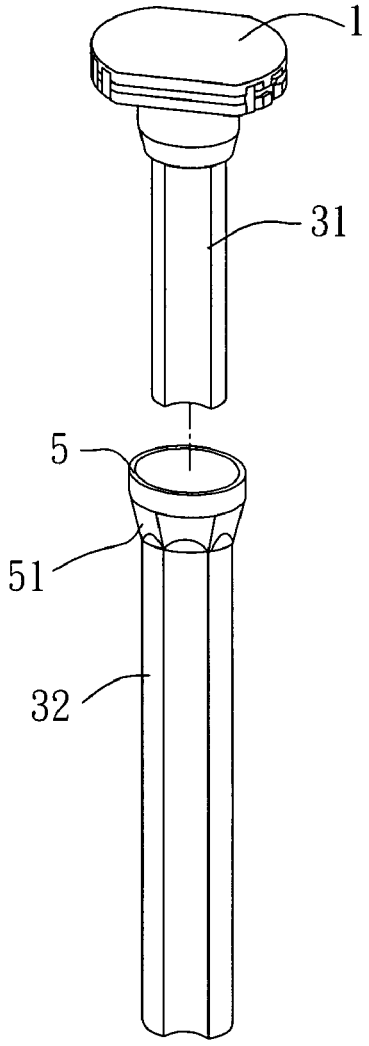
FIG. 6 is an exploded view to show the inner tube and the outer tube with the stopper in FIG. 5 of the umbrella of the present invention.

FIGS. 5 and 6 show that the stopper 5 is an annular member which is integrally formed with the outer tube 32 by way of pressing. The shaft 3 does not need to be made a slot and maintains the structural strength which ensures that the shaft 3 does not break during operation.

Figure 7:
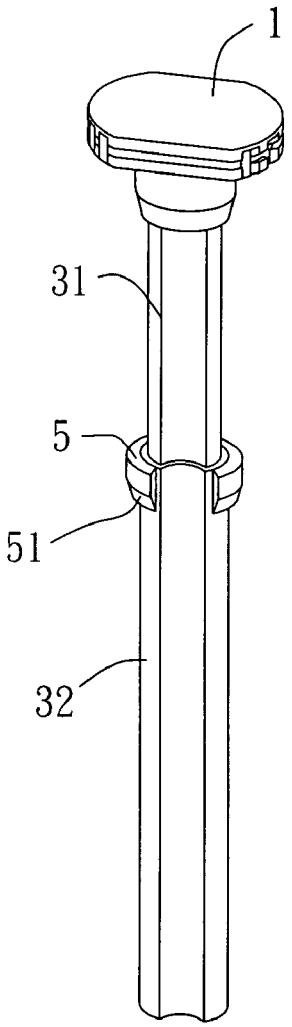
FIG. 7 is a perspective view to show the third embodiment of the stopper on the outer tube of the shaft of the umbrella of the present invention.
Figure 8:
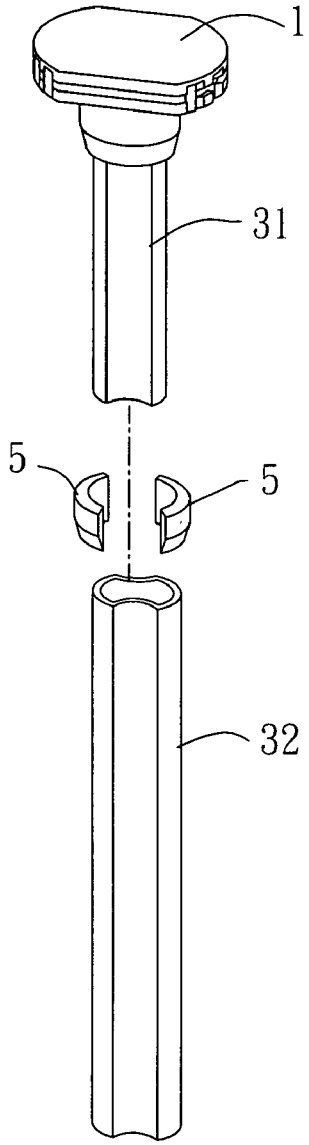
FIG. 8 is an exploded view of the stopper in FIG. 7 of the umbrella of the present invention.

FIGS. 7 and 8 show that the stopper 5 is an annular member which is composed of multiple pieces fixed to the outer tube 32 by way of rivets or any known method.

Figure 9:
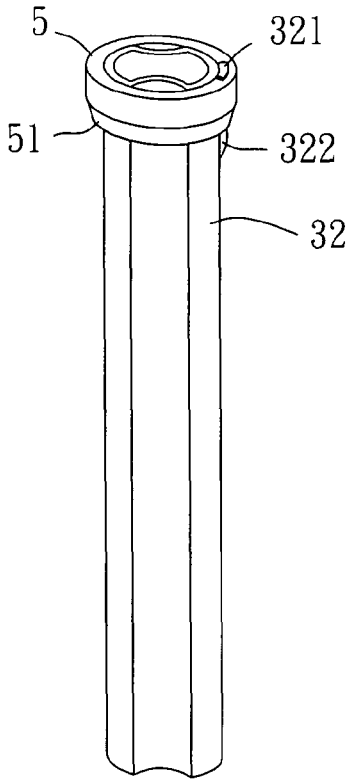
FIG. 9 shows the fourth embodiment of the stopper on the outer tube of the shaft of the umbrella of the present invention.
Figure 10:
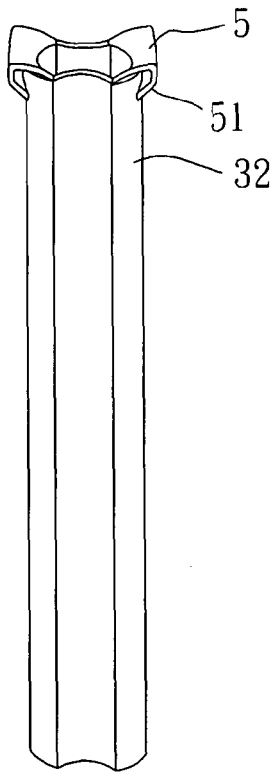
FIG. 10 shows the fifth embodiment of the stopper on the outer tube of the shaft of the umbrella of the present invention.

FIG. 9 shows that the stopper 5 is an annular member which is fixed to the outer tube 32 and the stopper 5 has multiple outward flips 321 so as to press the stopper 5 in position. The lower end of the stopper 5 is positioned by a boss 322 on the outer tube 32. The stopper 5 has a tapered lower outer periphery 51 so that the protrusion 61 of the button 6 can be guided along the tapered lower outer periphery 51 and moved to the top of the stopper 5. FIG. 10 shows that there are two pieces to form the stopper 5 and the two pieces can be integrally formed with the outer tube 32 and extend outward by way of pressing. The tapered lower outer periphery 51 of the stopper 5 guides the protrusion 61 of the button 6 to be moved to the top of the stopper 5.

While we have shown and described the embodiment in accordance with the present invention, it should be clear to those skilled in the art that further embodiments may be made without departing from the scope of the present invention.

What is claimed is:

1. An umbrella comprising:

a shaft with a top member connected to a top end of the shaft and a runner movably mounted to the shaft, multiple stretchers pivotably connected between the top member and the runner, the shaft including an inner tube and an outer tube in which the inner tube is retractably received, the runner movably mounted to the outer tube, the outer tube having a stopper extending outward from an outside of an upper end of the outer tube and the stopper having a tapered lower outer periphery, an outer diameter of the stopper is smaller than an inner diameter of the runner, the runner having a control button, the control button having a protrusion to be rested on the stopper when the runner is being movable over the stopper and supported by the stopper when the umbrella is opened, and the control button being compressed to disengage from the stopper when the runner being movable downward along the outer tube to close the umbrella.

2. The umbrella as claimed in claim 1, wherein the stopper is an annular member fixed on the outer tube.

3. The umbrella as claimed in claim 1, wherein the stopper is an annular member which is integrally formed with the outer tube.

4. The umbrella as claimed in claim 1, wherein the stopper is an annular member which is composed of multiple pieces fixed to the outer tube.

5. The umbrella as claimed in claim 1, wherein the stopper is an annular member which is composed of multiple pieces integrally formed with the outer tube.

* * * * *